US010878768B2

(12) United States Patent
Oh et al.

(10) Patent No.: US 10,878,768 B2
(45) Date of Patent: Dec. 29, 2020

(54) DISPLAY DEVICE SUPPORTING NORMAL AND VARIABLE FRAME MODES

(71) Applicant: SAMSUNG DISPLAY CO., LTD., Yongin-si (KR)

(72) Inventors: Kwan-Young Oh, Hanam-si (KR); Yoongu Kim, Seoul (KR); Sukjin Park, Daejeon (KR); Wonhee Lee, Bucheon-si (KR); Sangsu Han, Hanam-si (KR); Jae-Han Lee, Hwaseong-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 16/256,349

(22) Filed: Jan. 24, 2019

(65) Prior Publication Data

US 2019/0244579 A1 Aug. 8, 2019

(30) Foreign Application Priority Data

Feb. 8, 2018 (KR) ..... 10-2018-0015742

(51) Int. Cl.
*G09G 3/36* (2006.01)
*G09G 3/20* (2006.01)
*G09G 3/3291* (2016.01)

(52) U.S. Cl.
CPC ..... *G09G 3/3688* (2013.01); *G09G 3/2022* (2013.01); *G09G 3/3291* (2013.01);
(Continued)

(58) Field of Classification Search
CPC ..... G09G 2310/0291; G09G 2310/066; G09G 2330/021; G09G 2330/023;
(Continued)

(56) References Cited

U.S. PATENT DOCUMENTS 8,542,221 B1 * 9/2013 Wyatt ..... G06F 15/00 345/204
2007/0046613 A1 * 3/2007 Ha ..... G09G 3/3688 345/98

(Continued)

FOREIGN PATENT DOCUMENTS

KR 1020040002746 1/2004
KR 100712553 5/2007

(Continued)

*Primary Examiner* — Chun-Nan Lin
(74) *Attorney, Agent, or Firm* — F. Chau & Associates, LLC

(57) ABSTRACT

A method of operating a display device involves detecting whether a frame mode of the display device is a normal mode in which image data are received with a constant frame rate or a variable frame mode in which the image data are received with a variable frame rate. An output buffer drivability of a data driver included in the display device may be set according to the detected frame mode, and an image is displayed by outputting data voltages corresponding to the image data with slew rates corresponding to the set output buffer drivability. Power consumption in output buffer amplifiers may be selectively lowered by setting a relatively low output buffer drivability corresponding to a relatively low slew rate.

18 Claims, 9 Drawing Sheets

(52) U.S. Cl.
CPC ..... *G09G 3/3696* (2013.01); *G09G 3/3614* (2013.01); *G09G 2310/0291* (2013.01); *G09G 2310/066* (2013.01); *G09G 2330/021* (2013.01); *G09G 2330/023* (2013.01); *G09G 2340/0435* (2013.01)

(58) Field of Classification Search
CPC ..... G09G 2340/0435; G09G 3/2022; G09G 3/3291; G09G 3/3614; G09G 3/3688; G09G 3/3696
See application file for complete search history.

(56) References Cited

U.S. PATENT DOCUMENTS

| | | | | |
|---|---|---|---|---|
| 2018/0061352 | A1 | 3/2018 | Kim et al. | |
| 2018/0286305 | A1* | 10/2018 | Kim | G09G 3/30 |

FOREIGN PATENT DOCUMENTS

| | | |
|---|---|---|
| KR | 100717278 | 5/2007 |
| KR | 100947782 | 3/2010 |

* cited by examiner

FIG. 6

NORMAL MODE

510

| | | | |
|---|---|---|---|
| + | − | + | − |
| + | − | + | − |
| + | − | + | − |
| + | − | + | − |

530

| | | | |
|---|---|---|---|
| − | + | − | + |
| − | + | − | + |
| − | + | − | + |
| − | + | − | + |

FIG. 7

VARIABLE FRAME MODE

550

| | | | |
|---|---|---|---|
| + | − | + | − |
| − | + | − | + |
| + | − | + | − |
| − | + | − | + |

570

| | | | |
|---|---|---|---|
| − | + | − | + |
| + | − | + | − |
| − | + | − | + |
| + | − | + | − |

DISPLAY DEVICE SUPPORTING NORMAL AND VARIABLE FRAME MODES

CROSS-REFERENCE TO RELATED APPLICATION(S)

This application claims priority under 35 USC § 119 to Korean Patent Application No. 10-2018-0015742, filed on Feb. 8, 2018 in the Korean Intellectual Property Office (KIPO), the content of which is incorporated herein by reference in its entirety.

BACKGROUND

1. Technical Field

This disclosure relates generally to display devices, and more particularly to display devices supporting normal and variable frame rate modes and methods of operating the same.

2. Discussion of the Related Art

A content frame rate is a frame rate at which a host processor such as a graphic processing unit (GPU) or a graphic card supplies image data to a display device. A display refresh rate (or just "refresh rate") is a rate at which a display device screen is updated with image voltages. Recently developed display devices such as a liquid crystal displays (LCDs) or organic light emitting diode (OLED) devices operate in both a "normal mode" and a "variable frame mode". In a normal mode, both the content frame rate and the refresh rate are constant from frame to frame and are synchronized. Here, the refresh rate may be the same as, or a multiple of, the content frame rate.

In rendering systems, however, the content frame rate, also called the rendering frame rate, may be variable from frame to frame. In particular, when the host processor provides the display device with frame data for a game image that requires complicated rendering, the host processor may use longer frame lengths (lower frame rates) for complex video segments that require more rendering time. If the rendering frame rate is variable and the display refresh rate is not, a mismatch may occur between the rendering frame rate and the display refresh rate. In systems that aren't configured to correct it, the mismatch may cause a tearing phenomenon where a boundary line appears in the display image.

To prevent the tearing phenomenon, a variable refresh rate mode (e.g., Free-Sync™, G-Sync™, etc.), i.e., the above-noted "variable frame mode", has been developed. In this mode, the host processor provides frame data to the display device with a variable frame rate by changing blank period length from frame to frame. A display device supporting the variable frame mode may have a refresh rate equaling (or an integer multiple of) the content frame rate. Thus, a variable refresh rate is synchronized with the variable content frame rate, thereby preventing the tearing phenomenon.

SUMMARY

In a display device supporting a normal mode of a constant frame rate and a variable frame mode of a variable frame rate, embodiments described herein may optimize power consumption according to the normal mode or the variable frame mode. Power consumption in output buffer amplifiers may be reduced in the normal mode by reducing bias current, thereby reducing a slew rate of data signals output to pixels, relative to the slew rate used in the variable frame mode.

According to example embodiments, a method of operating a display device involves detecting whether a frame mode of the display device is a normal mode in which image data are received with a constant frame rate or a variable frame mode in which the image data are received with a variable frame rate. An output buffer drivability of a data driver included in the display device may be set according to the detected frame mode, and an image is displayed by outputting data voltages corresponding to the image data with respective slew rates corresponding to the set output buffer drivability. Power consumption may be selectively reduced by setting lower output buffer drivability and lower slew rates in the normal mode.

In various example embodiments:

To set the output buffer drivability, an output buffer drivability register included in the data driver may be set to a first output buffer drivability level when the detected frame mode is the variable frame mode, and the output buffer drivability register included in the data driver may be set to a second output buffer drivability level lower than the first output buffer drivability level when the detected frame mode is the normal mode.

To display the image, the data voltage may be output with a first slew rate corresponding to the first output buffer drivability level when the detected frame mode is the variable frame mode, and the data voltages may be output with a second slew rate corresponding to the second output buffer drivability level when the detected frame mode is the normal mode. The second slew rate may be less than the first slew rate.

An active period of each frame in the normal mode may be longer than an active period of each frame in the variable frame mode.

One horizontal time in the normal mode may be longer than one horizontal time in the variable frame mode.

A polarity inversion type may be set according to the detected frame mode.

When the detected frame mode is the variable frame mode, the data voltages may be output alternatingly in a first polarity inversion type, and, when the detected frame mode is the normal mode, the data voltages may be output alternatingly in a second polarity inversion type different from the first polarity inversion type.

The first polarity inversion type may be one of a one-dot inversion type, a two-dot inversion type, a column inversion type, a row inversion type and a frame inversion type, and the second polarity inversion type may be another one of the one-dot inversion type, the two-dot inversion type, the column inversion type, the row inversion type and the frame inversion type.

A decision on whether to perform charge sharing may be set according to the detected frame mode.

When the detected frame mode is the variable frame mode, the charge sharing may not be performed, and, when the detected frame mode is the normal mode, the charge sharing may be performed.

According to example embodiments, there is provided a display device including a display panel including a plurality of pixels, a gate driver configured to provide a gate signal to the plurality of pixels, a data driver configured to provide data voltages to the plurality of pixels, and a timing controller configured to receive image data, and to control the gate driver and the data driver. The timing controller detects whether a frame mode of the display device is a normal mode in which image data are received with a constant frame rate or a variable frame mode in which the image data are received with a variable frame rate, and sets an output buffer drivability of the data driver according to the detected frame mode. The data driver outputs the data voltages corresponding to the image data with respective slew rates corresponding to the set output buffer drivability.

In example embodiments:

The timing controller may include a mode detector configured to detect whether the frame mode is the normal mode or the variable frame mode by measuring one horizontal time and a time of a blank period in at least one frame.

The data driver may include an output buffer drivability register. The timing controller may set the output buffer drivability register to a first output buffer drivability level when the detected frame mode is the variable frame mode, and may set the output buffer drivability register to a second output buffer drivability level lower than the first output buffer drivability level when the detected frame mode is the normal mode.

The data driver may further include a bias generator and output buffers. When the detected frame mode is the variable frame mode, the bias generator may provide the output buffers with a first bias current corresponding to the first output buffer drivability level, and the output buffers may output the data voltage with a first slew rate corresponding to the first bias current. When the detected frame mode is the normal mode, the bias generator may provide the output buffers with a second bias current corresponding to the second output buffer drivability level, and the output buffers may output the data voltage with a second slew rate corresponding to the second bias current. The second slew rate may be less than the first slew rate.

One horizontal time in the normal mode may be longer than one horizontal time in the variable frame mode.

The timing controller may set a polarity inversion type according to the detected frame mode.

The data driver may include a polarity inversion type register. When the detected frame mode is the variable frame mode, the timing controller may set the polarity inversion type register to a value indicating a first polarity inversion type, and the data driver may output the data voltage in the first polarity inversion type based on the value of the polarity inversion type register. When the detected frame mode is the normal mode, the timing controller may set the polarity inversion type register to a value indicating a second polarity inversion type different from the first polarity inversion type, and the data driver may output the data voltage in the second polarity inversion type based on the value of the polarity inversion type register.

The first polarity inversion type may be one of a one-dot inversion type, a two-dot inversion type, a column inversion type, a row inversion type and a frame inversion type, and the second polarity inversion type may be another one of the one-dot inversion type, the two-dot inversion type, the column inversion type, the row inversion type and the frame inversion type.

The timing controller may set whether to perform charge sharing according to the detected frame mode.

The data driver may include a charge sharing register. When the detected frame mode is the variable frame mode, the timing controller may set the charge sharing register to a value indicating that the charge sharing is not performed, and the data driver may not perform the charge sharing based on the value of the charge sharing register. When the detected frame mode is the normal mode, the timing controller may set the charge sharing register to a value indicating that the charge sharing is performed, and the data driver may perform the charge sharing based on the value of the charge sharing register.

As summarized above, the method of operating the display device and the display device according to example embodiments may set an output buffer drivability according to whether a frame mode of the display device is a normal mode in which image data are received with a constant frame rate or a variable frame mode in which the image data are received with a variable frame rate, thereby reducing power consumption in at least one selected one of different frame modes.

Further, the method of operating the display device and the display device according to example embodiments may set a polarity inversion type and/or charge sharing according to the frame mode of the display device, thereby further reducing power consumption in at least one selected one of different frame modes.

In another example embodiment, a display device includes: a display panel including a plurality of pixels; a gate driver configured to provide a gate signal to the plurality of pixels; a data driver; and a timing controller. The timing controller is configured to receive image data, control the gate driver and the data driver, and detect at least one of a frame rate mode or a frame rate of the image data. The data driver includes a plurality of output buffer amplifiers that provide data voltages to the plurality of pixels. The output buffer amplifiers are supplied with a varying bias signal to control power consumption thereof based on at least one of the frame rate mode or the frame rate.

The timing controller may detect the frame rate mode by detecting whether the image data is being supplied according to a constant frame rate or a variable frame rate. A level of the bias signal may be set to a first level when the variable frame rate is detected, and to a second level when the constant frame rate is detected, where the second level is lower than the first level. The bias signal may be a bias current.

BRIEF DESCRIPTION OF THE DRAWINGS

Illustrative, non-limiting example embodiments will be more clearly understood from the following detailed description in conjunction with the accompanying drawings, in which like reference characters denote like elements or functions, wherein:

FIG. 6 is a diagram for describing an example of a polarity inversion type in a normal mode.

FIG. 7 is a diagram for describing an example of a polarity inversion type in a variable frame mode.

DETAILED DESCRIPTION OF EMBODIMENTS

Hereinafter, embodiments of the present inventive concept will be explained in detail with reference to the accompanying drawings.

Figure 1:
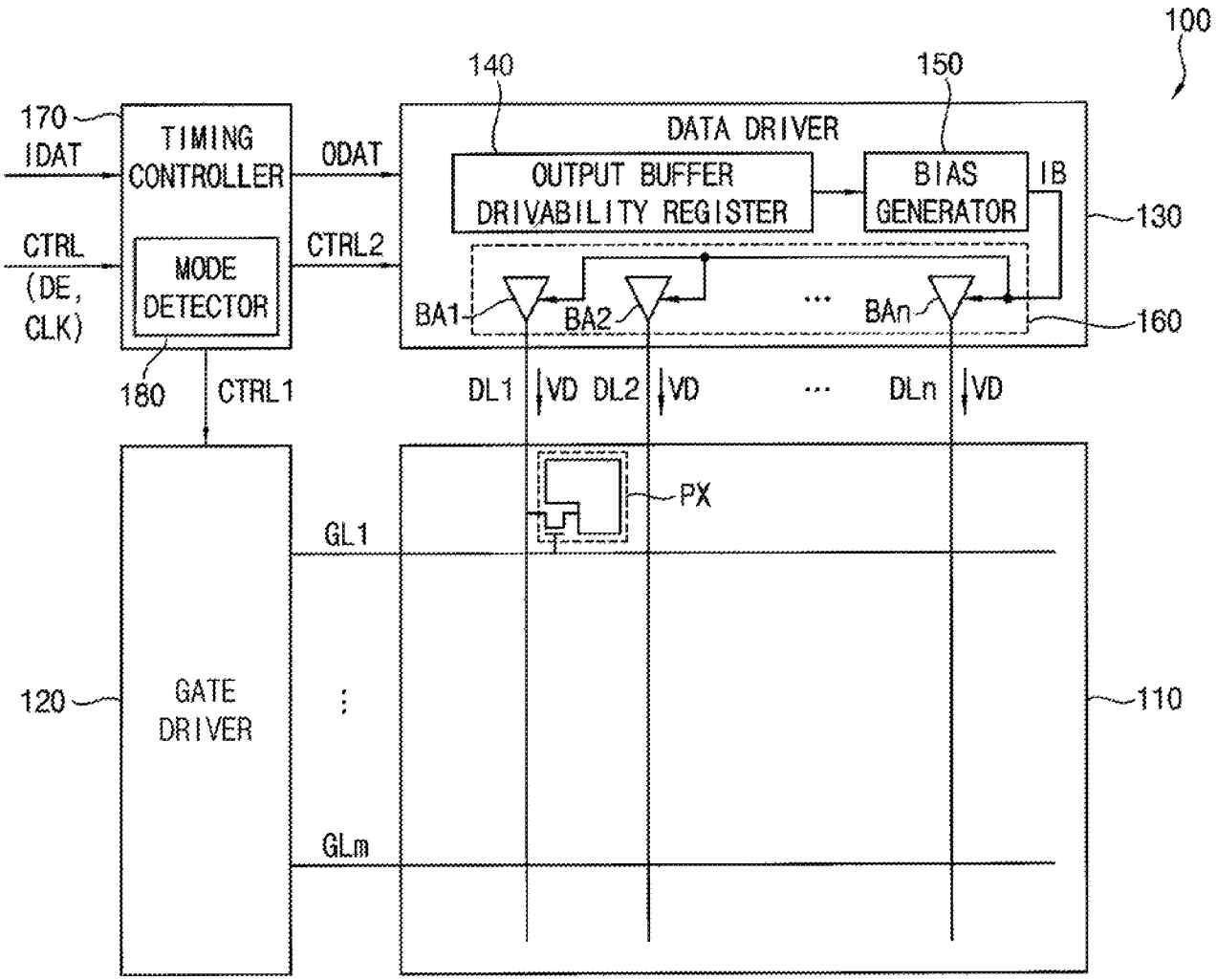
FIG. 1 is a block diagram illustrating a display device according to example embodiments.

FIG. 1 is a block diagram illustrating a display device, 100, according to example embodiments. Display device 100 may include a display panel 110 which includes a plurality of pixels PX in a grid layout (only one pixel is shown in FIG. 1), a gate driver 120 which provides a gate signal to the plurality of pixels PX, a data driver 130 which provides gray scale data voltages VD to the plurality of pixels PX, and a timing controller 170 which controls the gate driver 120 and the data driver 130.

The display panel 110 may include a plurality of gate lines GL1 to GLm, a plurality of data lines DL1, DL2 . . . DLn, and the plurality of pixels PX coupled to the plurality of gate lines GL1 to GLm and the plurality of data lines DL1 to DLn. As illustrated in FIG. 1, each pixel PX may include a switching transistor and a liquid crystal capacitor coupled to the switching transistor, for the case in which display panel 110 is a liquid crystal display (LCD) panel. In other examples, each pixel PX may include at least two transistors, at least one capacitor and an organic light emitting diode (OLED), and the display panel 110 may be an OLED display panel. However, any suitable display panel may be used. The voltages VD may be applied to respective pixels PX during any given frame with different gray scale values, depending on the target illumination levels for the pixels PX during the frame to generate an overall image.

The gate driver 120 may generate the gate signal based on a gate control signal CTRL1 from the timing controller 170, and may sequentially apply the gate signal to the plurality of gate lines GL1 to GLm. Gate control signal CTRL1 may include, but is not limited to, a gate clock signal and a scan start pulse. The gate driver 120 may be mounted directly on the display panel 110, coupled to the display panel 110 in a form of a tape carrier package (TCP), or may be integrated in a peripheral portion of the display panel 110.

The data driver 130 may generate the data voltages VD based on image data ODAT and a data control signal CTRL2 output from the timing controller 170, and may apply the data voltages VD to the plurality of data lines DL1 to DLn. The data control signal CTRL2 may include a horizontal start signal and a load signal. Data driver 130 may be mounted directly on the display panel 110, coupled to the display panel 110 in a form of a TCP, or may be integrated in the peripheral portion of the display panel 110.

The timing controller 170 may receive image data IDAT and a control signal CTRL from an external host processor (e.g., a graphic processing unit (GPU)). The image data IDAT may be RGB data including red image data, green image data and blue image data. Control signal CTRL may include a data enable signal DE and a pixel clock signal CLK. The timing controller 170 may generate the gate control signal CTRL1, the data control signal CTRL2 and the image data ODAT based on the control signal CTRL and the image data IDAT. The timing controller 170 may control an operation of the gate driver 120 by providing the gate control signal CTRL1 to the gate driver 120, and may control an operation of the data driver 130 by providing the data control signal CTRL2 and the image data ODAT to the data driver 130.

The host processor (e.g., the GPU) may provide the image data IDAT with a constant frame rate from frame to frame to the display device 100 in a normal mode, and may provide the image data IDAT with a variable frame rate to the display device 100 in a variable frame mode. For example, the host processor may change the frame rate from frame to frame by allowing a length of a blank period to change in each frame in the variable frame mode. The timing controller 170 may detect whether a frame mode of the display device 100 should be set to the normal mode or the variable frame mode. To this end, the timing controller 170 may include a mode detector 180 which detects whether the frame mode of the host processor is the normal mode or the variable frame mode.

A time between successive falling edges or between successive rising edges of the DE signal may be referred to as a "one horizontal" or "1H" time, which corresponds to a time during which one horizontal row of pixels is refreshed with data voltages VD. In an example, mode detector 180 may detect whether the frame mode is the normal mode or the variable frame mode by measuring the 1H time and a time of a blank period in at least one frame based on the pixel clock signal CLK provided from the host processor and/or an oscillator clock signal generated by an internal oscillator of the timing controller 170. For example, the mode detector 180 may decide that the frame mode is the normal mode when the 1H time is relatively long and the time of the blank period is constant from frame to frame, and may decide that the frame mode is the variable frame mode when the 1H time is relatively short and the time of the blank period is variable. In another example, the image data IDAT may be provided to timing controller 170 with a field indicating whether the frame mode is normal or variable, where the field may also indicate the content frame rate. Mode detector 180 may detect the mode from the information in this field.

The data driver 130 may include output buffers 160, e.g., a bank of output buffer amplifiers BA1 to Ban connected to data lines DL1 to DLn, respectively. To drive a pixel PX with an updated data voltage of a new frame, or to refresh a pixel PX with a previous data voltage of a current frame, each output buffer amplifier BA1 to BAn may output a data voltage signal VD in a pulsed waveform. A leading edge of the pulsed waveform may be characterized in terms of a slew rate, that is, a change in its voltage vs. time. For example, referring momentarily to FIG. 4, the slew rates of a data voltage VD in signal diagrams 350 and 370 are different, where the voltage in diagram 370 has a faster slew rate than that in diagram 350. It is also noted that slew rate may refer to an absolute value of the slope of the waveform. Thus, during a negative polarity time interval (e.g., the right hand side of signal diagram 350), a negative pulse is generated and the slope of the leading edge is negative. However, signal diagram 350 illustrates that data voltage VD has approximately the same slew rate (in absolute value) for the positive and negative polarity time intervals (and the same can be said for data voltage VD in signal diagram 370).

As shown in FIG. 1, a bias generator 150 of the data driver 130 may bias each buffer amplifier BA1 to BAn with a bias signal, that is, a bias current IB (or alternatively a bias voltage). The higher the bias current IB biasing any given buffer amplifier BAi, the higher the slew rate of an output voltage generated by the buffer amplifier BAi, and the higher the power consumption of the buffer amplifier BAi. According to the present inventive concept, power consumption of the buffer amplifiers BA1 to BAn is reduced by selectively lowering the bias current IB under a particular condition. A condition for lowering bias current may be that minimal noticeable difference in image quality occurs (e.g., when a parameter for an amount of image quality degradation is below a threshold). Hereinbelow, an example is presented in which the normal mode of operation is selected as a candidate for lowering the bias current IB and thereby reducing power consumption. In this example, the normal mode has a longer active period AP than that of the variable frame mode (as discussed below for FIG. 3) such that a lower slew rate may have negligible impact on image quality.

Herein, the term "output buffer drivability" refers to a characteristic of an output buffer amplifier to drive a pixel PX with a pulsed data voltage in a manner positively correlated with slew rate. Thus, an output buffer amplifier BAi or the output buffers 160 (i.e., the bank of buffer amplifiers BA to Ban, collectively) may be said to have a relatively high or low output buffer drivability if the data voltage(s) output thereby has a relatively fast or slow slew rate, respectively. A given configuration for output buffers 160 may exhibit a high or low output buffer drivability when driven with a high or low bias current IB, respectively, causing power consumption in the output buffers to be respectively high or low.

The timing controller 170 may set an output buffer drivability of the data driver 130 according to the detected frame mode, and the data driver may output the data voltage VD corresponding to the image data ODAT with a slew rate corresponding to the set output buffer drivability. As just explained, slew rate may be defined as an absolute value of the slope of the data voltage VD waveform's leading edge. It should be noted, however, that the peak value of the data voltage VD (the flat area of the VD waveforms in FIG. 4) output to any given pixel depends on the target illumination for that pixel in the current frame. Since the peak values of VD differ from pixel to pixel, the slew rate may be defined as a slope value to a normalized peak value of the waveform. The slew rate may be understood or defined, in relative terms, as inversely correlated to the time taken during the 1H interval for the data voltage VD to reach the peak value of the waveform. In this case, the slew rate may be understood or defined in terms of a ratio of the time taken from the beginning of the 1H interval to reach the peak value of the data voltage VD, to the total 1H time period. (Relatively speaking, the higher the ratio, the lower the slew rate).

Data driver 130 may further include an output buffer drivability register 140 that stores a current output buffer drivability level. Timing controller 170 may set the output buffer drivability register 140 to a first output buffer drivability level when the frame mode detected by the mode detector 180 is the variable frame mode, and may set the output buffer drivability register 140 to a second output buffer drivability level lower than the first output buffer drivability level when the frame mode detected by the mode detector 180 is the normal mode. For example, the output buffer drivability register 140 may store 3-bit data, and the timing controller 170 may write data of "HHH" indicating the first output buffer drivability level to the output buffer drivability register 140 when the detected frame mode is the variable frame mode, and may write data of "HLL" indicating the second output buffer drivability level to the output buffer drivability register 140 when the detected frame mode is the normal mode. In other examples, n-bit data is used, where n is less than or higher than three.

To output the data voltages VD with a slew rate corresponding to the output buffer drivability level set to the output buffer drivability register 140, the data driver may further include the bias generator 150 which generates the bias current B. The bias current IB may correspond to the output buffer drivability level set to the output buffer drivability register 140. The output buffers 160 output the data voltages VD based on the bias current B. For example, when the detected frame mode is the variable frame mode, the bias generator 150 may provide the output buffers 160 with a first bias current corresponding to the first output buffer drivability level, and the output buffers 160 may output the data voltages VD with a first slew rate corresponding to the first bias current. Further, when the detected frame mode is the normal mode, the bias generator 150 may provide the output buffers 160 with a second bias current corresponding to the second output buffer drivability level, and the output buffers 160 may output the data voltages VD with a second slew rate corresponding to the second bias current. In this case, the second slew rate may be less than the first slew rate. Accordingly, power consumption in the normal mode may be reduced relative to the case in which the data voltages VD would have otherwise been output with the first slew rate in the normal mode.

In a conventional display device, although the 1H time in the normal mode is longer than the 1H time in the variable frame mode, a data driver of the conventional display device may output data voltages with a fixed slew rate suitable for the 1H time corresponding to the highest frame rate supported by the conventional display device, or for the shorted 1H a time independent of the frame mode. For example, the 1H time interval in the normal mode having a constant frame rate of about 60 Hz is about 14.8 μs. In this case, the data driver of the conventional display device may output the data voltages with a fast slew rate that is capable of charging pixels within a much shorter 1H time interval. In particular, a conventional display device may use a 1H time interval of about 6.2 μs for the variable frame mode having a variable frame rate ranging from about 25 Hz to about 144 Hz, and sets the slew rate of the normal mode the same as that in the variable frame mode.

However, the display device 100 according to example embodiments may detect whether the frame mode is the normal mode or the variable frame mode, and may set the output buffer drivability of the data driver 130 according to the detected frame mode. Thus, the data driver 130 may output the data voltages VD with relatively high output buffer drivability, coinciding to a higher slew rate in the variable frame mode, and may output the data voltages VD with relatively low output buffer drivability coinciding with a lower slew rate in the normal mode. Accordingly, the display device 100 according to example embodiments may operate with an output buffer drivability suitable for each of different frame modes, thereby minimizing the power consumption in the different frame modes and, in particular, reducing the power consumption in the normal mode.

Figure 2:
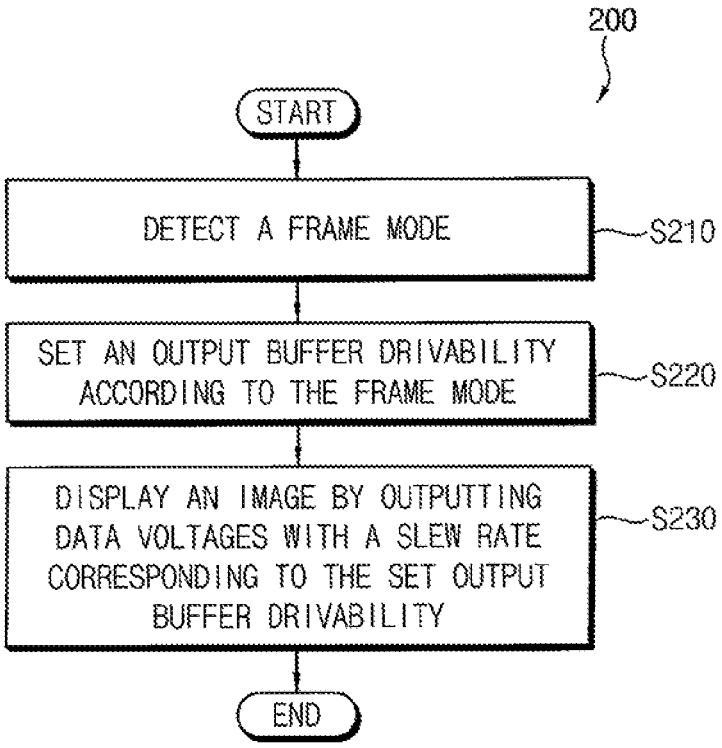
FIG. 2 is a flowchart illustrating a method of operating a display device according to example embodiments.
Figure 3:
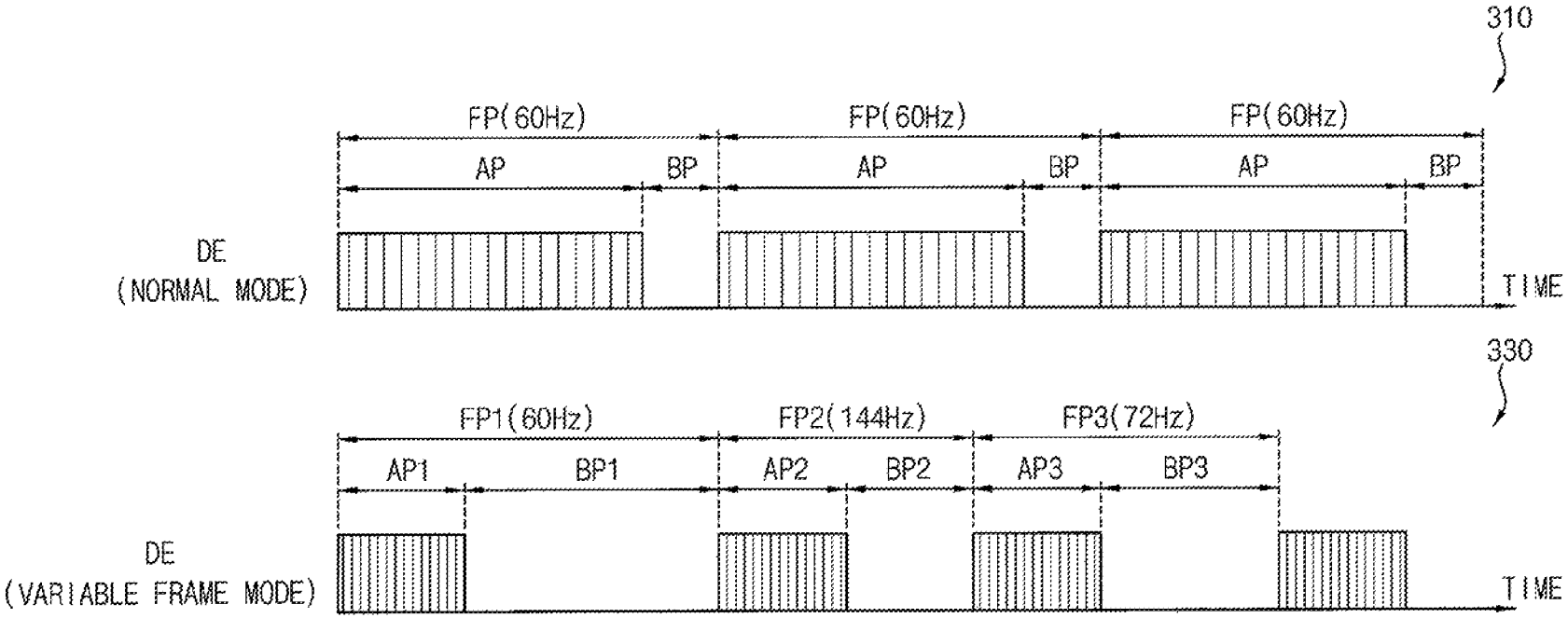
FIG. 3 is a diagram for describing examples of frames in a normal mode and frames in a variable frame mode.
Figure 4:
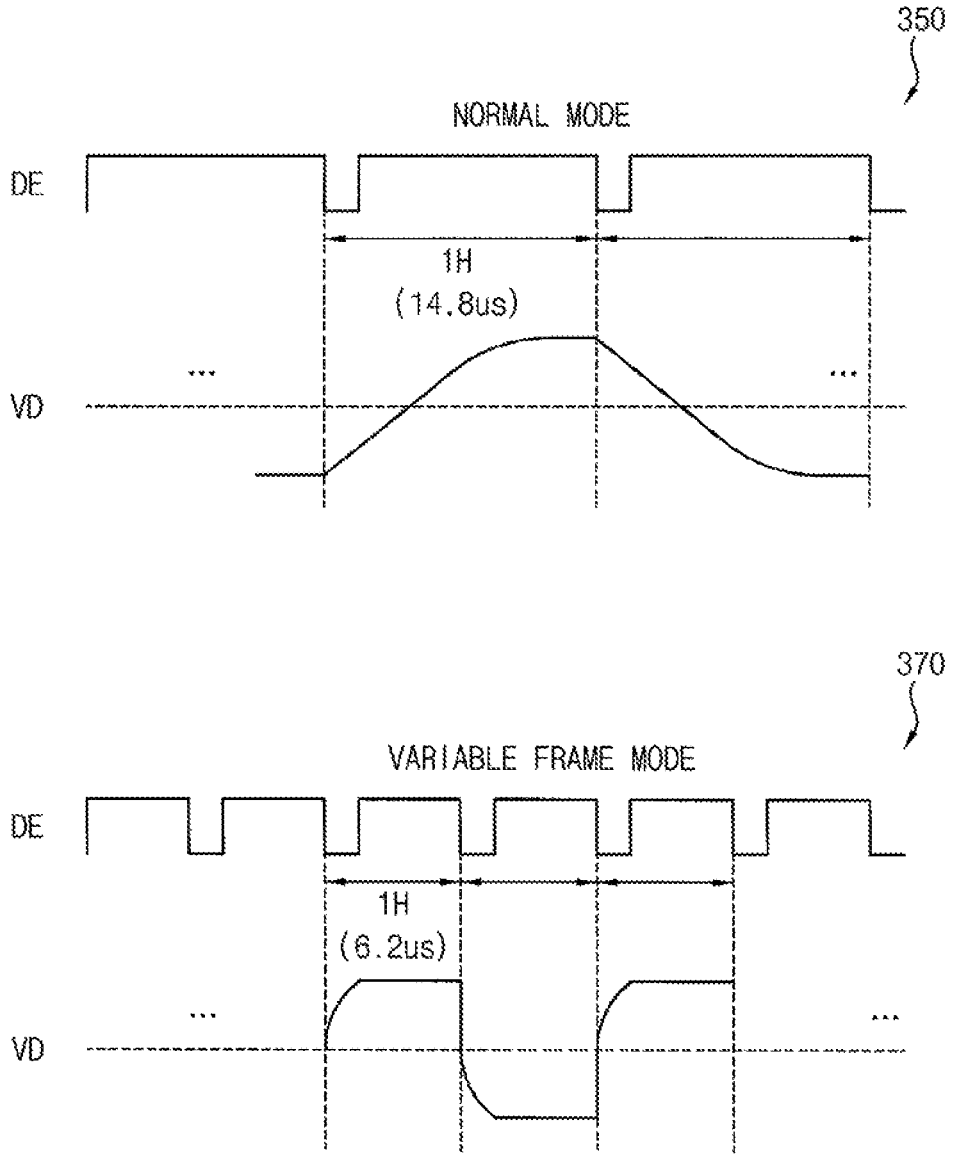
FIG. 4 is a diagram for describing examples of a data voltage in a normal mode and a data voltage in a variable frame mode.

FIG. 2 is a flowchart illustrating a method 200 of operating a display device according to example embodiments, and FIG. 3 is a diagram for describing examples of frames in a normal mode and frames in a variable frame mode. FIG. 4 is a diagram for describing examples of a data voltage in a normal mode and a data voltage in a variable frame mode.

Referring collectively to FIGS. 1-4, in method 200, mode detector 180 may detect whether a frame mode of the display device 100 is a normal mode in which image data IDAT are received with a constant frame rate or a variable frame mode in which the image data IDAT are received with a variable frame rate (S210).

For example, as indicated by signal sequence 310 in FIG. 3, in each frame period FP of the normal mode, an active period AP in which a data enable signal DE continuously toggles and the image data IDAT are received may have a constant length. (Herein, "length" in the context of signals is understood to be in units of time). A blank period BP in which the data enable signal DE is deactivated and the image data IDAT are not received also may have a constant length. Accordingly, in the normal mode, the frame period FP of each frame may have a constant length, and the image data IDAT may be received with a constant frame rate of about 60 Hz.

However, as indicated by signal sequence 330 in FIG. 3, in each frame period FP1, FP2 and FP3 of the variable frame mode, an active period AP1, AP2 and AP3 in which the data enable signal DE continuously toggles and the image data IDAT are received may have a constant length, but a length of a blank period BP1, BP2 and BP3 in which the data enable signal DE is deactivated and the image data IDAT are not received may be changed from frame to frame. That is, the length of the blank period BP1, BP2 and BP3 is permitted to change in each successive frame in the variable frame mode. Thus, a length of the frame period FP1, FP2 and FP3 of each frame may be variable, and the image data IDAT may be received with a variable frame rate, for example, ranging from about 25 Hz to about 144 Hz. In the example of FIG. 3, first frame data may be received at about a 60 Hz rate, second frame data may be received at about 144 Hz, and third frame data may be received at about 72 Hz.

A length of the active period AP1, AP2 and AP3 in the variable frame mode may be set suitable for the maximum frame rate within the range of the variable frame rate, for example a frame rate of about 144 Hz. Accordingly, the active period AP in the normal mode which is set suitable for the constant frame rate, for example the frame rate of about 60 Hz, may be longer than the active period AP1, AP2 and AP3 in the variable frame mode. Thus, the 1H time of the normal mode may be longer than the 1H time of the variable frame mode. (Note that each vertical "rectangle" in the AP sections of the signal diagrams illustrates a time during which a single horizontal row of pixels receives data. Thus, FIG. 3 illustrates that even for the same frame rate of 60 Hz, the 1H times in the normal mode are longer than the 1H times in the variable frame mode.) For example, as illustrated in FIG. 4, the 1H time of the normal mode may be about 14.8 μs, and the 1H time of the variable frame mode may be about 6.2 μs.

The timing controller 170 may set an output buffer drivability of a data driver 130 according to the frame mode detected by the mode detector 180 (S220). Timing controller 170 may set an output buffer drivability register 140 to a first output buffer drivability level when the detected frame mode is the variable frame mode, and may set the output buffer drivability register 140 to a second output buffer drivability level lower than the first output buffer drivability level when the detected frame mode is the normal mode.

To display an image, the data driver 130 may output data voltages VD corresponding to the image data ODAT with a slew rate corresponding to the output buffer drivability set to the output buffer drivability register 140 (S230). Data driver 130 may output the data voltages VD with a first slew rate corresponding to the first output buffer drivability level when the detected frame mode is the variable frame mode, and may output the data voltages VD with a second slew rate corresponding to the second output buffer drivability level when the detected frame mode is the normal mode. The second slew rate may be less than the first slew rate.

For example, as indicated by signal sequence 370 in FIG. 4, in the variable frame mode, a data voltage VD may be output with a relatively high slew rate such that pixels PX are charged within a relatively short 1 H time (e.g., about 6.2 μs). However, as indicated by signal sequence 350 in FIG. 4, in the normal mode having a relatively long 1H time (e.g., about 14.8 μs), a data voltage VD may be output with a relatively low slew rate. Accordingly, since the data voltage VD is output with the slew rate suitable for each of different frame modes, power consumption of the data driver 130 and the display device 100 may be optimized in the different frame modes. In particular, the power consumption in the normal mode may be reduced.

Figure 5:
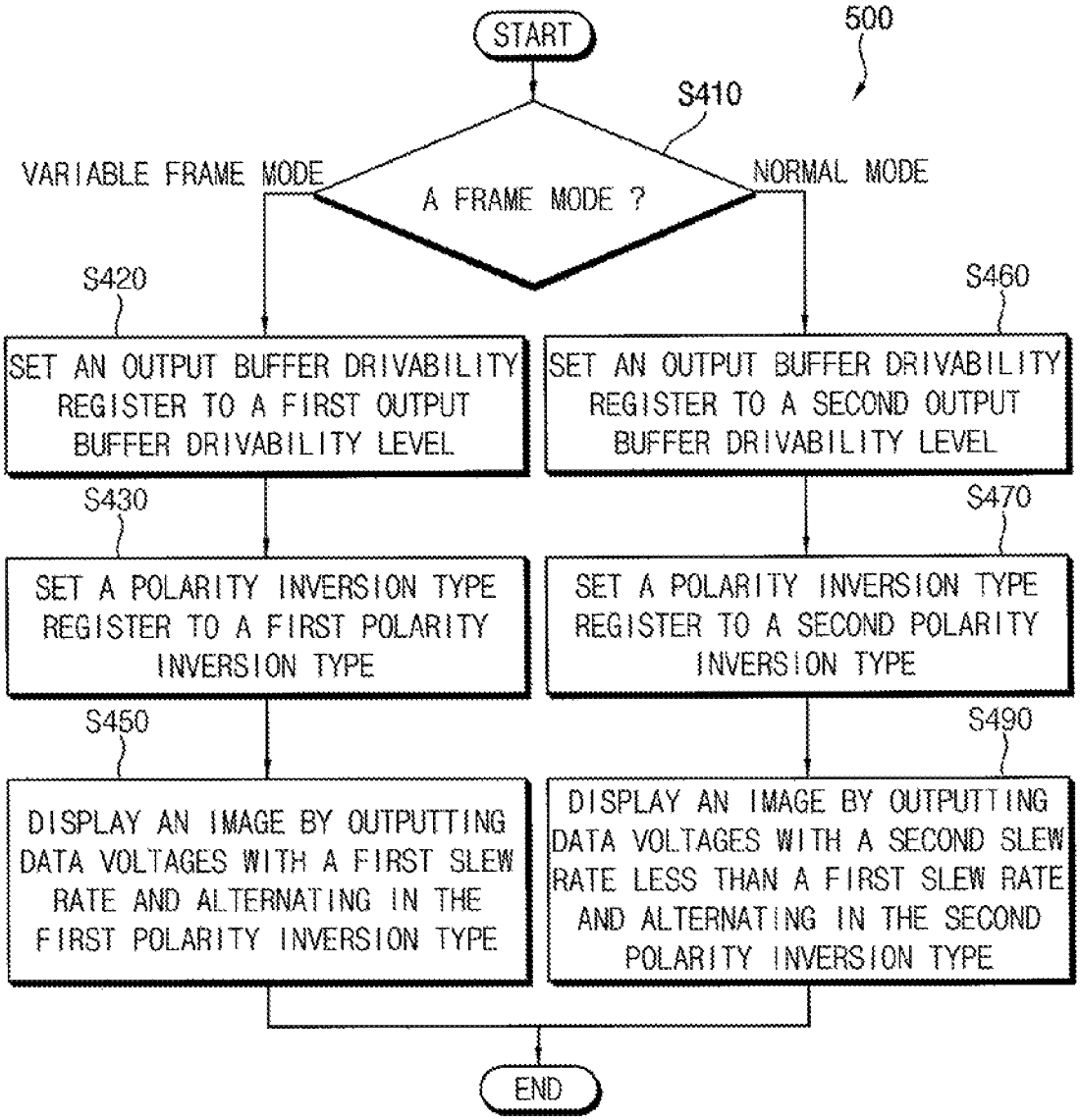
FIG. 5 is a flowchart illustrating a method of operating a display device according to example embodiments.

FIG. 5 is a flowchart illustrating a method 500 of operating a display device according to example embodiments. FIG. 6 is a diagram for describing an example of a polarity inversion type in a normal mode, and FIG. 7 is a diagram for describing an example of a polarity inversion type in a variable frame mode.

Compared with a method 200 illustrated in FIG. 2, method 500 may further include steps (S430 and S470) of setting different polarity inversion types with respect to respective frame modes. In method 500, mode detector 180 of timing controller 170 may detect whether a frame mode of the display device is a normal mode in which image data are received with a constant frame rate or a variable frame mode in which the image data are received with a variable frame rate (S410).

If the detected frame mode is the variable frame mode (S410 result: VARIABLE FRAME MODE), the timing controller may set an output buffer drivability register 140 of data driver 130 to a first output buffer drivability level (S420), and may set a polarity inversion type register of the data driver to a value indicating a first polarity inversion type (S430). The data driver may output data voltages with a first slew rate corresponding to the first output buffer drivability level and alternating in the first polarity inversion type to display an image (S450). The first polarity inversion type may be one of a one-dot inversion type, a two-dot inversion type, a column inversion type, a row inversion type and a frame inversion type. For example, as illustrated in FIG. 7, the data driver may perform polarity inversion of the one-dot inversion type in the variable frame mode, but the polarity inversion type of the variable frame mode. In case of the one-dot inversion type, the data driver may output data voltages having opposite polarities to adjacent pixels. Further, the data driver may apply the data voltages having a first polarity to pixels in an odd-numbered frame 550, and may apply the data voltage having a second polarity inverted from the first polarity to pixels in an even-numbered frame 570.

If the detected frame mode is the normal mode (S410: NORMAL MODE), the timing controller may set the output buffer drivability register to a second output buffer drivability lower than the first output buffer drivability level (S460), and may set the polarity inversion type register to a value indicating a second polarity inversion type different from the first polarity inversion type (S470). The data driver may output the data voltages with a second slew rate less than the first slew rate and corresponding to the second output buffer drivability level and in the second polarity inversion type different from the first polarity inversion type to display an image (S490). In some example embodiments, the second polarity inversion type is another one of the one-dot inversion type, the two-dot inversion type, the column inversion type, the row inversion type and the frame inversion type. For example, as illustrated in FIG. 6, the data driver may perform the polarity inversion of the column inversion type in the normal mode. In case of the column inversion type, the data driver may output data voltages having opposite polarities in adjacent columns. Further, the data driver may apply the data voltages having a first polarity to a column in an odd-numbered frame 510, and may apply the data voltage having a second polarity inverted from the first polarity to the column in an even-numbered frame 530. In examples illustrated in FIGS. 6 and 7, since the polarity inversion of the column inversion type having relatively low power consumption (compared with the one-dot inversion type) is performed in the normal mode, the power consumption in the normal mode may be further reduced. Other selections for polarity types that differ between the normal mode and the variable frame mode may also result in power consumption reduction in the normal mode or the variable mode.

Figure 8:
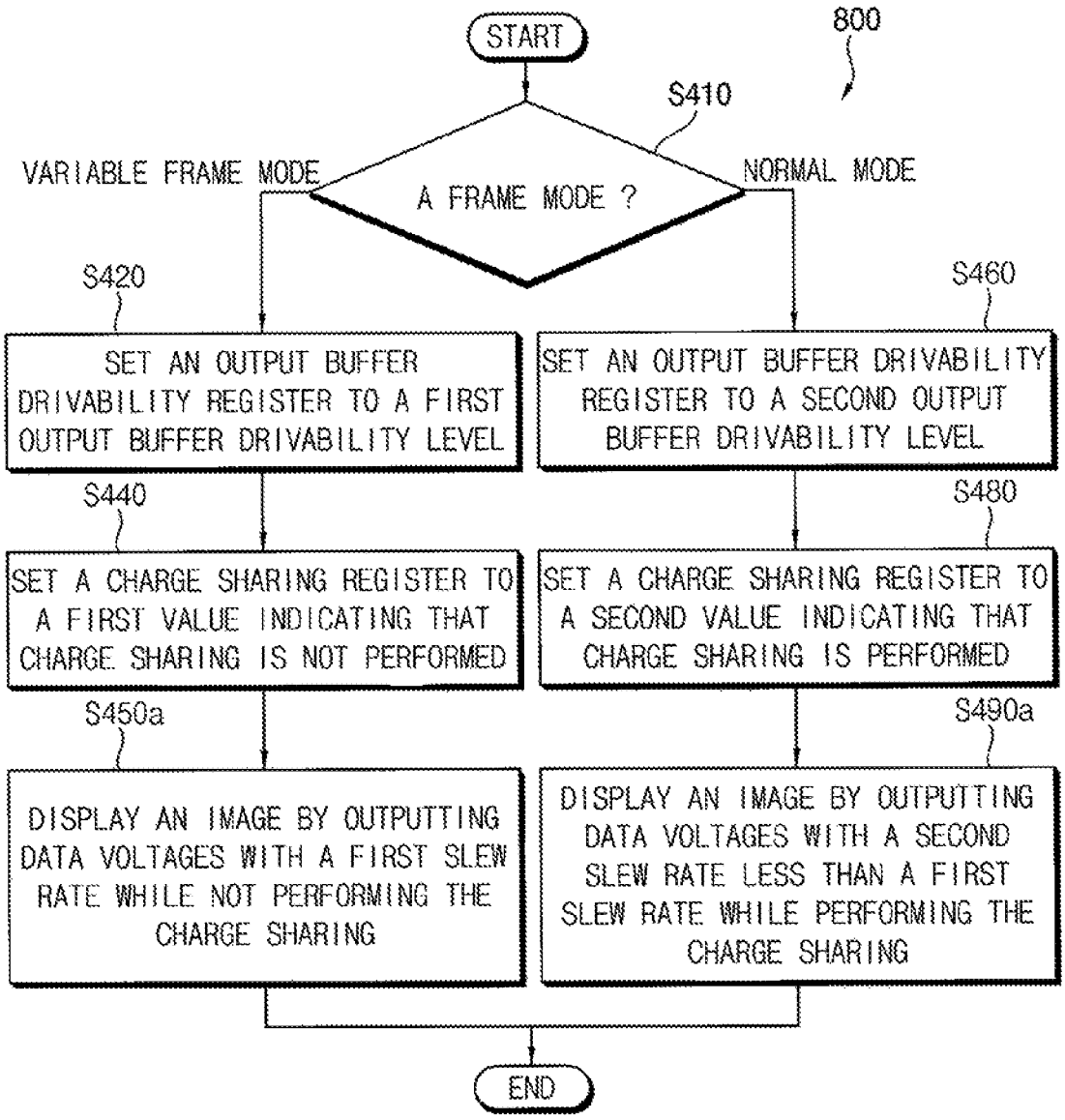
FIG. 8 is a flowchart illustrating a method of operating a display device according to example embodiments.

FIG. 8 is a flowchart illustrating a method 800 of operating a display device according to example embodiments. Compared with method 200 illustrated in FIG. 2, method 800 may further include steps (S440 and S480) of setting whether to perform charge sharing with respect to respective frame modes, and subsequent steps are based on the charge sharing settings. For example, to perform charge sharing, the data driver 130 may precharge data lines by connecting the data lines to each other before the data voltages are output. When charge sharing is performed, current supplying loads of output buffers 160 of the data driver 130 may be reduced, and power consumption may be reduced.

In method 800, a mode detector of a timing controller may detect whether a frame mode of the display device is a normal mode in which image data are received with a constant frame rate or a variable frame mode in which the image data are received with a variable frame rate (S410).

If the detected frame mode is the variable frame mode (S410: VARIABLE FRAME MODE), the timing controller may set an output buffer drivability register of a data driver to a first output buffer drivability level (S420), and may set a charge sharing register of the data driver to a first value indicating that the charge sharing is not performed (S440). The data driver may not perform the charge sharing, and may output a data voltage with a first slew rate corresponding to the first output buffer drivability level to display an image (S450*a*).

If the detected frame mode is the normal mode (S410: NORMAL MODE), the timing controller may set the output buffer drivability register to a second output buffer drivability lower than the first output buffer drivability level (S460), and may set the charge sharing register to a second value indicating that the charge sharing is performed (S480). The data driver may perform the charge sharing, and may output the data voltage with a second slew rate less than the first slew rate and corresponding to the second output buffer drivability level to display an image (S490*a*). For example, to perform the charge sharing, the data driver may precharge data lines by connecting the data lines to each other before the data voltage is output. Accordingly, current supplying loads of output buffers of the data driver may be reduced, and the power consumption in the normal mode may be further reduced.

Figure 9:
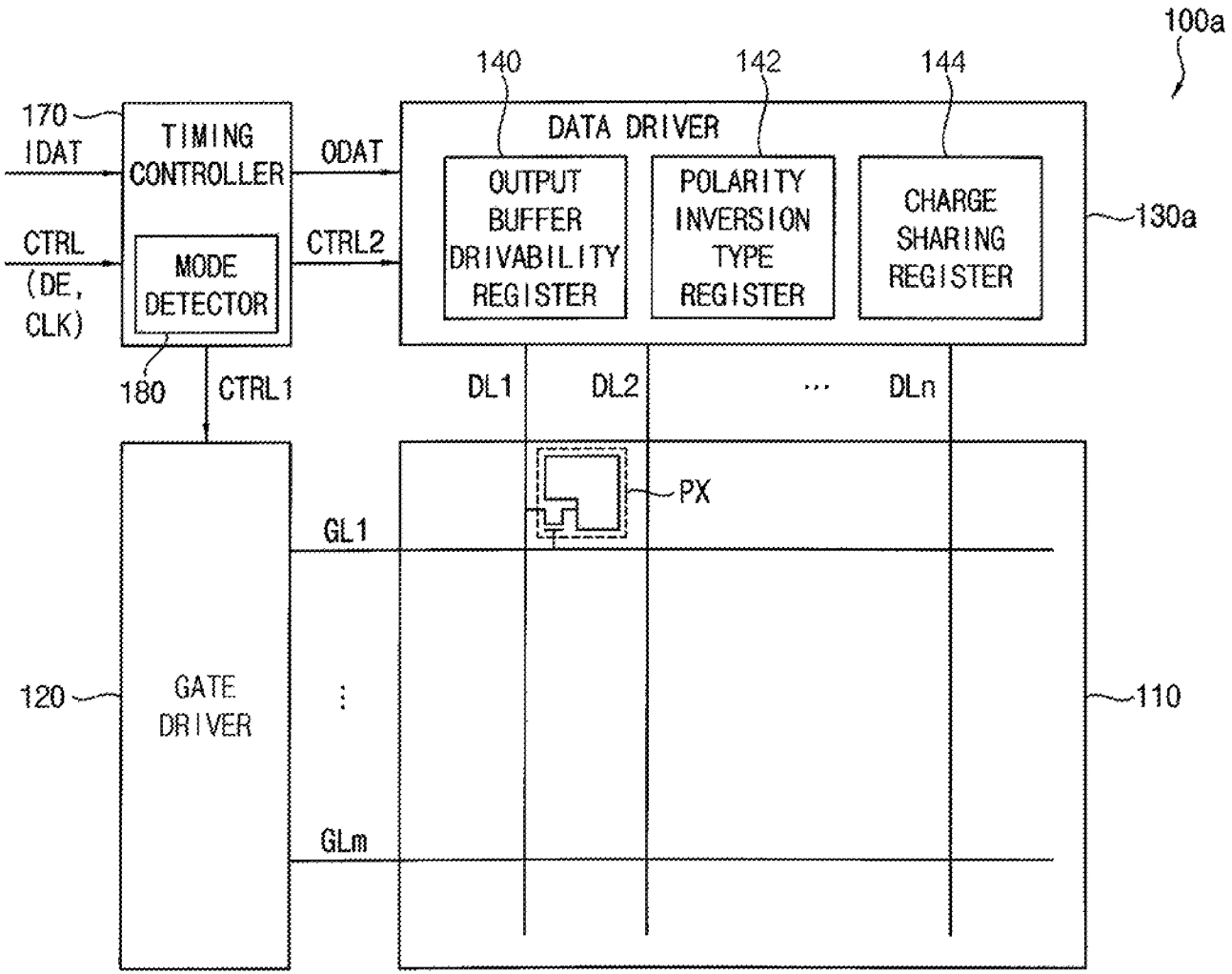
FIG. 9 is a block diagram illustrating a display device according to example embodiments.

FIG. 9 is a block diagram illustrating a display device, 100*a*, according to example embodiments. Display device 100*a* may be used to perform the methods 500 and/or 800 of FIGS. 5 and 8 discussed above. Display device 100*a* may have similar configurations and operations to a display device 100 of FIG. 1, except that a data driver 130*a* may further include, in addition to output buffer drivability register 140, a polarity inversion type register 142 and a charge sharing register 144.

The timing controller 170 may detect whether a frame mode of the display device 100*a* is a normal frame mode or a variable frame mode, and may set a polarity inversion type according to the detected frame mode. Timing controller 170 may set the polarity inversion type register 142 to a first value indicating a first polarity inversion type when the detected frame mode is the variable frame mode, and may set the polarity inversion type register 142 to a second value indicating a second polarity inversion type different from the first polarity inversion type when the detected frame mode is the normal mode. The data driver 130*a* may output data voltages VD in the first polarity inversion type based on the first value set to the polarity inversion type register 142 when the detected frame mode is the variable frame mode, and may output the data voltages VD in the second polarity inversion type based on the second value set to the polarity inversion type register 142 when the detected frame mode is the normal mode. The first polarity inversion type may be one of a one-dot inversion type, a two-dot inversion type, a column inversion type, a row inversion type and a frame inversion type, and the second polarity inversion type may be another one of the one-dot inversion type, the two-dot inversion type, the column inversion type, the row inversion type and the frame inversion type.

The timing controller 170 may set whether to perform charge sharing according to the detected frame mode. Timing controller 170 may set the charge sharing register 144 to a first value indicating that the charge sharing is not performed when the detected frame mode is the variable frame mode, and may set the charge sharing register 144 to a second value indicating that the charge sharing is performed when the detected frame mode is the normal mode. The data driver 130*a* may not perform the charge sharing based on the first value set to the charge sharing register 144 when the detected frame mode is the variable frame mode, and may perform the charge sharing based on the second value set to the charge sharing register 144 when the detected frame mode is the normal mode.

Figure 10:
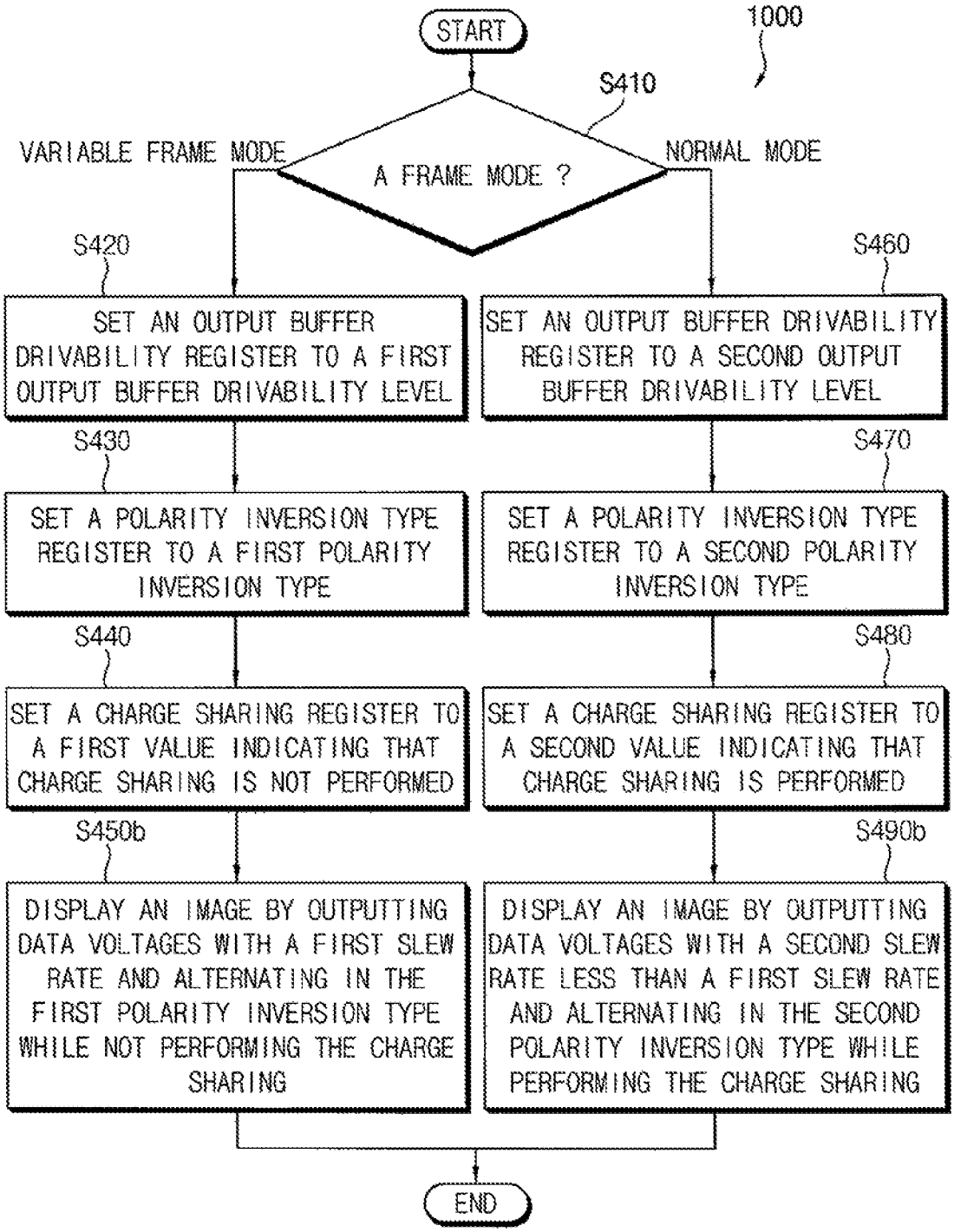
FIG. 10 is a flowchart illustrating a method of operating a display device according to example embodiments.

FIG. 10 is a flowchart illustrating a method 1000 of operating a display device according to example embodiments. Method 1000 may include all of steps (S430 and S470) of setting different polarity inversion types with respect to respective frame modes in method 500 of FIG. 5 and steps (S440 and S480) of setting whether to perform charge sharing with respect to the respective frame modes in method 800 of FIG. 8. Method 1000 may be performed by display device 100*a* of FIG. 9.

In method 1000, mode detector 180 may detect whether a frame mode of the display device is a normal mode in which image data are received with a constant frame rate or a variable frame mode in which the image data are received with a variable frame rate (S410).

If the detected frame mode is the variable frame mode (S410 result: VARIABLE FRAME MODE), the timing controller may set an output buffer drivability register of a data driver to a first output buffer drivability level (S420), may set a polarity inversion type register of the data driver to a value indicating a first polarity inversion type (S430), and may set a charge sharing register of the data driver to a first value indicating that the charge sharing is not performed (S440). The data driver may not perform the charge sharing, and may output a data voltage with a first slew rate corresponding to the first output buffer drivability level and in the first polarity inversion type to display an image (S450*b*).

If the detected frame mode is the normal mode (S410: NORMAL MODE), the timing controller may set the output buffer drivability register to a second output buffer drivability lower than the first output buffer drivability level (S460), may set the polarity inversion type register to a value indicating a second polarity inversion type different from the first polarity inversion type (S470), and may set the charge sharing register to a second value indicating that the charge sharing is performed (S480). The data driver may perform the charge sharing, and may output the data voltage with a second slew rate less than the first slew rate and corresponding to the second output buffer drivability level and in the second polarity inversion type different from the first polarity inversion type to display an image (S490*b*).

The inventive concepts may be applied to any display device supporting the normal mode and the variable frame mode, and any electronic device including the display device. For example, the inventive concepts may be applied to a television (TV), a digital TV, a 3D TV, a smart phone, a wearable electronic device, a tablet computer, a mobile phone, a personal computer (PC), a home appliance, a laptop computer, a personal digital assistant (PDA), a portable multimedia player (PMP), a digital camera, a music player, a portable game console, a navigation device, etc.

In the above-described example embodiments, the normal mode is selected as a mode in which bias current of output buffer amplifiers is reduced to thereby lower power consumption while slew rates are reduced. In other embodiments, other criteria may be used to select when to lower bias current. For instance, the inventive concept may be applied to reduce power consumption while operating within a variable frame rate mode during times in which frame rates are below a threshold. Accordingly, alternative embodiments may use a "look ahead" approach in which the host processor determines, during a variable frame rate mode, whether a predetermined number of frames to be rendered will be supplied at a frame rate below a threshold. If so, the host processor provides an indication of such to the timing controller 170, and the display device 100 responds by initiating a "bias reduction mode" for the output buffer amplifiers, in which bias current IB is reduced. Concurrently in this bias reduction mode, the timing controller may cause the AP times and 1H times to be temporarily lengthened just for those frames to be displayed below the threshold frame rate. Then, the slew rate reduction technique as described above for the normal mode, which stems from the reduction in bias current IB, may be similarly used in the variable mode to reduce power consumption as these frames are displayed below the threshold frame rate.

Any one of the above-described elements for manipulating, generating and/or processing data and signals, such as any of the above-described timing controller, mode detector, data driver, gate driver, output buffer drivability register, polarity inversion type register, charge sharing register and bias generator may include electronic circuitry such as a special purpose hardware circuit or processor or a general purpose processor that executes instructions read from a memory to run a routine to carry out the element's function. Various ones of the above described elements may be embodied as part of the same processor, which executes instructions at different stages to carry out the functions of the components sequentially, or using parallel processing. With the use of parallel processing, various ones of the components may be embodied as respective processing elements of a parallel processor. Alternatively, the various elements may be embodied as part of a plurality of different processors. For example, with such a composition based on hardware circuitry, the above-discussed timing controller, mode detector, data driver, gate driver, output buffer drivability register, polarity inversion type register, charge sharing register and bias generator may alternatively be called, respectively, a timing controller circuit, mode detector circuit, data driver circuit, gate driver circuit, output buffer drivability register circuit, polarity inversion type register circuit, charge sharing register circuit and bias generator circuit, circuitry, hardware, or the like.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the present inventive concept. Accordingly, all such modifications are intended to be included within the scope of the present inventive concept as defined in the appended claims.

What is claimed is:

1. A method of operating a display device, the method comprising:

detecting whether a frame mode of the display device is a normal mode in which image data are received with a constant frame rate;

detecting whether the frame mode of the display device is a variable frame mode in which the image data are received with a variable frame rate;

setting an output buffer drivability of a data driver included in the display device according to the detected frame mode; and displaying an image by outputting data voltages corresponding to the image data with respective slew rates corresponding to the set output buffer drivability.

2. The method of claim 1, wherein setting the output buffer drivability includes:

setting an output buffer drivability register included in the data driver to a first output buffer drivability level when the detected frame mode is the variable frame mode; and setting the output buffer drivability register included in the data driver to a second output buffer drivability level lower than the first output buffer drivability level when the detected frame mode is the normal mode.

3. The method of claim 2, wherein displaying the image includes:

outputting the data voltages with a first slew rate corresponding to the first output buffer drivability level when the detected frame mode is the variable frame mode; and outputting the data voltages with a second slew rate corresponding to the second output buffer drivability level when the detected frame mode is the normal mode, and wherein the second slew rate is less than the first slew rate.

4. The method of claim 1, wherein an active period of each frame in the normal mode is longer than an active period of each frame in the variable frame mode.

5. The method of claim 1, wherein one horizontal time in the normal mode is longer than one horizontal time in the variable frame mode.

6. The method of claim 1, further comprising:

setting a polarity inversion type according to the detected frame mode.

7. The method of claim 6, wherein, when the detected frame mode is the variable frame mode, the data voltages are output alternatingly in a first polarity inversion type, and wherein, when the detected frame mode is the normal mode, the data voltages are output alternatingly in a second polarity inversion type different from the first polarity inversion type.

8. The method of claim 7, wherein the first polarity inversion type is one of a one-dot inversion type, a two-dot inversion type, a column inversion type, a row inversion type and a frame inversion type, and wherein the second polarity inversion type is another one of the one-dot inversion type, the two-dot inversion type, the column inversion type, the row inversion type and the frame inversion type.

9. The method of claim 1, further comprising:

setting whether to perform charge sharing according to the detected frame mode.

10. The method of claim 9, wherein, when the detected frame mode is the variable frame mode, the charge sharing is not performed, and wherein, when the detected frame mode is the normal mode, the charge sharing is performed.

11. A display device comprising:

a display panel including a plurality of pixels;

a gate driver configured to provide a gate signal to the plurality of pixels;

a data driver configured to provide data voltages to the plurality of pixels; and a timing controller configured to receive image data, and to control the gate driver and the data driver, wherein the timing controller is configured to: (i) detect whether a frame mode of the display device is a normal mode in which image data are received with a constant frame rate; (ii) detect whether the frame mode of the display device is a variable frame mode in which the image data are received with a variable frame rate; and (iii) set an output buffer drivability of the data driver according to the detected frame mode, and wherein the data driver outputs the data voltages corresponding to the image data with respective slew rates corresponding to the set output buffer drivability.

12. The display device of claim 11, wherein the timing controller includes:

a mode detector configured to detect whether the frame mode is the normal mode or the variable frame mode by measuring one horizontal time and a time of a blank period in at least one frame.

13. The display device of claim 11, wherein the data driver includes an output buffer drivability register, and wherein the timing controller sets the output buffer drivability register to a first output buffer drivability level when the detected frame mode is the variable frame mode, and sets the output buffer drivability register to a second output buffer drivability level lower than the first output buffer drivability level when the detected frame mode is the normal mode.

14. The display device of claim 13, wherein the data driver further includes a bias generator and output buffers, and wherein, when the detected frame mode is the variable frame mode, the bias generator provides the output buffers with a first bias current corresponding to the first output buffer drivability level, and the output buffers output the data voltages with a first slew rate corresponding to the first bias current, wherein, when the detected frame mode is the normal mode, the bias generator provides the output buffers with a second bias current corresponding to the second output buffer drivability level, and the output buffers output the data voltages with a second slew rate corresponding to the second bias current, and wherein the second slew rate is less than the first slew rate.

15. The display device of claim 11, wherein one horizontal time in the normal mode is longer than one horizontal time in the variable frame mode.

16. The display device of claim 11, wherein the timing controller sets a polarity inversion type according to the detected frame mode.

17. The display device of claim 16, wherein the data driver includes a polarity inversion type register, wherein, when the detected frame mode is the variable frame mode, the timing controller sets the polarity inversion type register to a value indicating a first polarity inversion type, and the data driver outputs the data voltages alternatingly in the first polarity inversion type based on the value of the polarity inversion type register, and wherein, when the detected frame mode is the normal mode, the timing controller sets the polarity inversion type register to a value indicating a second polarity inversion type different from the first polarity inversion type, and the data driver outputs the data voltages alternatingly in the second polarity inversion type based on the value of the polarity inversion type register.

18. The display device of claim 11, wherein the timing controller sets whether to perform charge sharing according to the detected frame mode.

* * * * *